US005562075A

United States Patent [19]

Walsh

[11] Patent Number: 5,562,075

[45] Date of Patent: Oct. 8, 1996

[54] OSCILLATING DRIVE SHAFT AND RELATED COMPONENTS CONFIGURATION FOR RECIPROCATING PISTON ENGINES

[76] Inventor: Noel J. Walsh, 17 Picardy Street, Everglen, Durbanville 7550, South Africa

[21] Appl. No.: 437,162

[22] Filed: May 8, 1995

[51] Int. Cl.[6] ..... F02B 75/26

[52] U.S. Cl. ..... 123/197.1

[58] Field of Search ..... 123/197.1, 197.4, 123/197.5; 74/810.1, 126, 129

[56] References Cited

U.S. PATENT DOCUMENTS

| | | | |
|---|---|---|---|
| 1,612,917 | 1/1927 | Grimes | 123/197.1 |
| 2,779,201 | 1/1957 | Hurley | 123/197.5 |
| 3,943,894 | 3/1976 | Sumpter | 123/197.1 |
| 3,991,736 | 11/1976 | Spellman | 123/197.5 |
| 4,433,649 | 2/1984 | Shin | 123/197.5 |
| 5,025,756 | 6/1991 | Nyc | 123/197.4 |

FOREIGN PATENT DOCUMENTS

| | | | |
|---|---|---|---|
| 0822741 | 11/1951 | Germany | 123/197.1 |

*Primary Examiner*—Marguerite McMahon

[57] ABSTRACT

This invention relates to an Oscillating Drive Shaft (ODS) and related components that replaces the crankshaft of reciprocating piston engines. The ODS is positioned to the left and/or right of the piston/s line of travel. The distance of the ODS from the center line of the piston's direction of travel is determined by the design nee& of the engine. One or more arms/beams (depending on the number of pistons) are fixed on the ODS. These arms are then connected to the reciprocating pistons using a suitable medium (e.g. connecting rod or gears) so that the reciprocating travel of the piston imparts an oscillating or rocking motion to the ODS. The ODS then passes through ratcheted gears or ratcheted flywheel (depending on requirements), converting the oscillating/rocking motion into the desired rotary direction of travel.

2 Claims, 1 Drawing Sheet

OSCILLATING DRIVE SHAFT AND RELATED COMPONENTS CONFIGURATION FOR RECIPROCATING PISTON ENGINES

FIELD OF THE INVENTION

The purpose of this invention is to greatly improve the efficiency of reciprocating piston engines by replacing the common reciprocating engine's crankshaft with the Oscillating (rocking) Drive Shaft and converting this rocking motion through ratcheted gears or ratcheted flywheel to one continuous desired direction of rotation for driving the end use.

BACKGROUND OF THE INVENTION

Internal combustion engines conventionally include a crank which is part of the engines power output shaft. The reciprocating power piston is connected to the crank by a connecting rod so that the piston's linear reciprocating motion is converted to rotational motion of the power shaft. The coupling between the connecting rod and the crank is such that the moment arm is less than the maximum when maximum force is applied by the piston.

The force is applied to the piston by the expansion of the combusting air/fuel mixture. As the expansion increases the moment arm increases and, simultaneously, the force from the expansion decreases. It is well known in the art that this conventional relationship of piston, connecting rod and crank effects less than the maximum available torque to the power shaft. This conventional arrangement wastes power as heat. Many earlier attempts have been made to increase mechanical efficiency of the piston engine by eliminating the angular and moment arm changes that the connecting rod undergoes in its relationship with the power output shaft and power piston. These attempts have serious drawbacks. Some do not increase the mechanical efficiency, i.e. U.S. Pat. No. 1,667,213 issued to Marchetti on Apr. 24, 1928. Others may increase the efficiency but sacrifice sturdiness or reliability as, for example, U.S. Pat. No. 4,363,299 issued Dec. 14, 1982 to Bristol and U.S. Pat. No. 4,498,430 issued Feb. 12, 1985 to Giuliani.

SUMMARY OF THE INVENTION

This invention is an improvement over earlier designs relating to reciprocating piston engines resulting in increased mechanical efficiency and reliability. An oscillating drive shaft and rocker arm is shown connected to the connecting rod at all times to raise the piston to its upward stroke and follow the rod on the downward stroke. The combination of parts and kinematics provides a moment arm of maximum length. The entire force from the power piston is applied to the moment arm resulting in fuel savings and more complete combustion to reduce pollutant emissions.

It is an object of this invention to maximize mechanical advantage.

Another object is to reduce fuel consumption relative to conventional engines of comparable power.

Another object is to increase thermal efficiency resulting in cooler running engines.

A longer than conventional piston stroke is attainable which permits more complete fuel burning and less pollution emittants.

Another object is to greatly increase power by increasing torque through a piston that often minimum resistance to the expanding combustion elements because the invention directs the entire force of the combustion as perpendicular as possible to a fixed length movement arm of the output power shaft. Other objects and advantages of the invention will become evident from further perusal of this disclosure.

A BRIEF DESCRIPTION OF DRAWING VIEWS

DESCRIPTION AND OPERATION OF INVENTION

Figure 1:
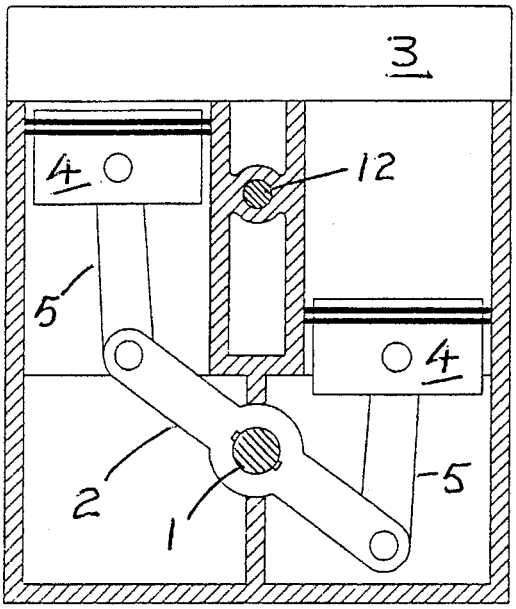
FIG. 1 Illustrates the front cut away view of a two piston engine with ODS in position and connected to the pistons by beams and piston connecting rods.
Figure 2:
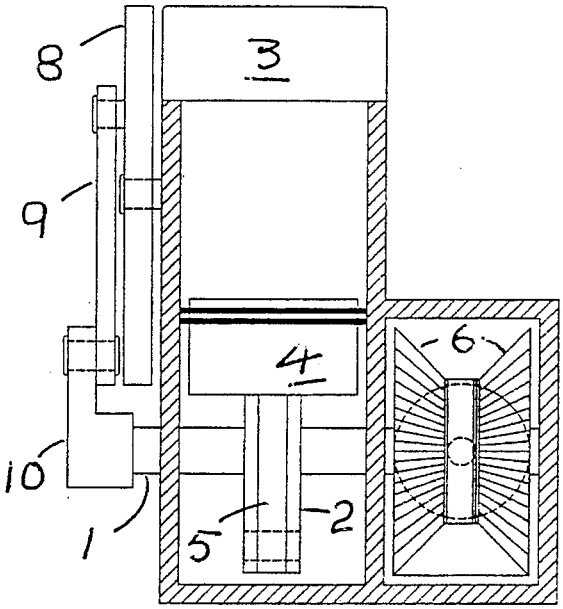
FIG. 2 Illustrates a cut away side view of the engine and a set of three gears which convert the oscillating motion of the ODS to rotary motion for power off take. It also shows the idling flywheel used for starting the engine and timing needs.
Figure 3:
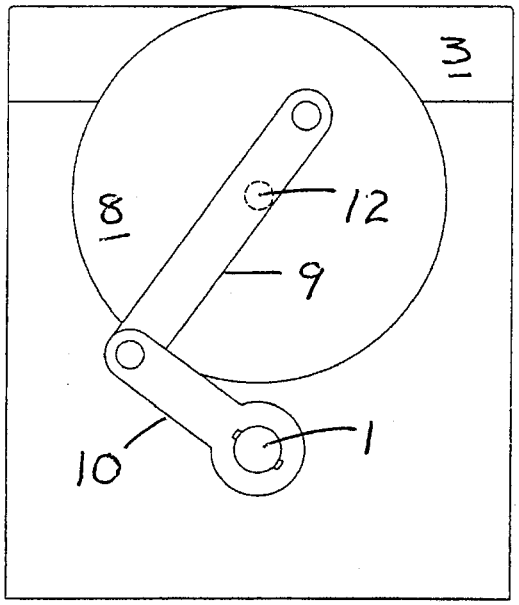
FIG. 3 Illustrates the front view of the engine and idling/timing flywheel.
Figure 4:
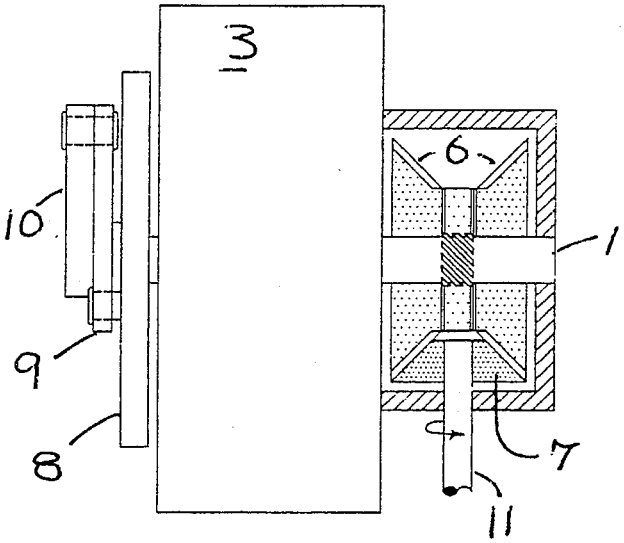
FIG. 4 Illustrates a top view of the engine and a cut away top view of the gearbox showing the direction of travel of the ratcheted gears and connecting power take off non-ratcheted pinion gear and shaft.

It will become obvious that this invention can use conventional methods as applicable to reciprocating piston engines of two stroke or four stroke cycle design for lubrication and electrical systems; push rods or timing chains and their related camshafts for valve operation; and the like. These obvious relationships with conventional engine working parts and systems are omitted in the disclosure to better concentrate on clarifying the novel aspects of the invention.

In 'View A' we observe the ODS 1 with its attached beam/arm 2 connected to the piston rods 5 which are in turn connected to the pistons 4. The pistons 4 are at their respective top and bottom of their strokes. Also shown is the timing flywheel shaft 12 and cylinder head 3.

In 'View B' we observe a side cut away view of the same engine illustrating the ODS, extending on either side of the pistons.

To the left of the pistons the ODS has fitted to it the timing flywheel beam/arm 10 in turn connected to the timing flywheel 8 by means of the timing flywheel connecting rod 9. The purpose of the timing flywheel which is cranked round by the ODS is to control the top and bottom dead centers of the piston strokes, by controlling the ODS arc of travel. The timing flywheel also, as needs be controls valve, spark and fuel injection timing. The timing flywheel is also used to start the engine.

To the right of the pistons the ODS extends and passes through two ratcheted (slip clutch mechanism) gears 6. The ratchets in these gears operate opposite to each other i.e. the ratchet clutches clockwise in one gear and anti-clockwise in the other. These gears ratchet's are set opposite to each other and set so that a positive driving force relating to the power strokes of the pistons is applied to each gear in turn as the ODS changes direction. A third gear 7 attached to a power take off shaft 11 meshes with the ratcheted gears. Because at any given time, one of the ratcheted gears is in a positive drive mode, the transference of power from the pistons through the ODS to the power take off gear is continuous and rotary in the desired direction of travel.

Having described my invention and its operation I claim:

1. An internal combustion engine having an oscillating drive shaft passing through the center of at least one beam having two halves, each half connected to a connecting rod, the two connecting rods each connected to one of a pair of pistons, each piston reciprocating in a cylinder such that as the combustion force drives the first piston downwardly the half of the beam directly connected to the first piston is driven downwardly and the other half of the beam is driven upwardly, thus forcing the second piston to move upwardly and causing the oscillating drive shaft to oscillate in one direction, this movement being reversed when the second piston enters into its power stroke, said oscillating drive shaft being connected to a timing flywheel by means of a beam and connecting rod, and said oscillating drive shaft passing into a bevel gearbox that converts oscillating power movement to continuous rotary motion.

2. The internal combustion engine as claimed in claim 1 wherein the bevel gearbox includes the arrangement of three bevel gears and a clutch for converting the oscillating motion of the oscillating drive shaft to continuous rotary power motion.

* * * * *